United States Patent [19]

Larsson

[11] Patent Number: 4,756,324

[45] Date of Patent: Jul. 12, 1988

[54] HYDRODYNAMIC NOZZLE FOR PRESSURIZED WATER CLEANING OF WATER, DISCHARGE AND SURFACE WATER PIPES

[76] Inventor: Bo Larsson, Box 8024, 390 08 Kalmar, Sweden

[21] Appl. No.: 835,868

[22] PCT Filed: Apr. 24, 1985

[86] PCT No.: PCT/SE85/00186

§ 371 Date: Jul. 25, 1986

§ 102(e) Date: Jul. 25, 1986

[87] PCT Pub. No.: WO85/05295

PCT Pub. Date: Dec. 5, 1985

[30] Foreign Application Priority Data

May 24, 1984 [SE] Sweden ..... 8402804

[51] Int. Cl.[4] ..... B08B 9/04

[52] U.S. Cl. ..... 134/167 C; 15/104.12; 239/DIG. 13

[58] Field of Search ..... 134/166 C, 167 C, 168 C, 134/169 C, 179; 239/DIG. 13, 251; 15/104.12

[56] References Cited

U.S. PATENT DOCUMENTS

| | | | |
|---|---|---|---|
| 1,587,194 | 6/1926 | Sladden | 134/167 C |

FOREIGN PATENT DOCUMENTS

| | | | |
|---|---|---|---|
| 400011 | 8/1924 | Fed. Rep. of Germany . | |
| 805209 | 5/1951 | Fed. Rep. of Germany . | |
| 816418 | 7/1959 | United Kingdom | 15/104.12 |
| 182451 | 5/1966 | U.S.S.R. | 15/104.12 |
| 671883 | 7/1979 | U.S.S.R. . | |
| 1015936 | 5/1983 | U.S.S.R. | 134/167 C |

*Primary Examiner*—Philip R. Coe

*Attorney, Agent, or Firm*—Beveridge, DeGrandi & Weilacher

[57] ABSTRACT

A movable hydrodynamic nozzle which removes deposits of sand, soil, sludges etc. in a pipe system. The nozzle is connected to a pressurized water pipe and pulls the pressurized water pipe into the pipe system. When known movable hydrodynamic nozzles are used, the cleaning efficiency is lower due to strong turbulence and frothing and to the fact that the resistance of the nozzle to the water flow is large. In accordance with the present invention this problem is solved by shaping the channels which guide the pressurized water from the main inlet portion of the nozzle to the outer back portion of the nozzle, in such a way that the pressurized water is entering the channels in the same direction as it has when it enters the main inlet portion. Additionally, the inlet openings and outlet openings of every channel are preferably diametrically opposed in order to give the channel an optimally large curve radius.

6 Claims, 4 Drawing Sheets

HYDRODYNAMIC NOZZLE FOR PRESSURIZED WATER CLEANING OF WATER, DISCHARGE AND SURFACE WATER PIPES

The present invention relates to a nozzle for hydrodynamic cleaning of pipe systems, particularly discharge and surface water pipe systems. Deposits of sand, soil, sludge etc must be removed, at regular intervals, from a water pipe system in order to prevent unsanitary conditions and the clogging of the pipes. The hydrodynamic nozzle according to the present invention is characterized, like nozzles in this technical field, by openings, which point backwards and from which water, due to pumping pressure, is sprayed against deposits in the pipe, dissolving this material and moving it backwards in order to be able to pump it from a well or the like. The nozzle pulls its pressurized water feed pipe through the water pipe, while working its way along the water pipe, due to the pressurized water jets pointed backwards, and freeing deposits at the same time and making this material flow backwards in the pipe.

Figure 1A:
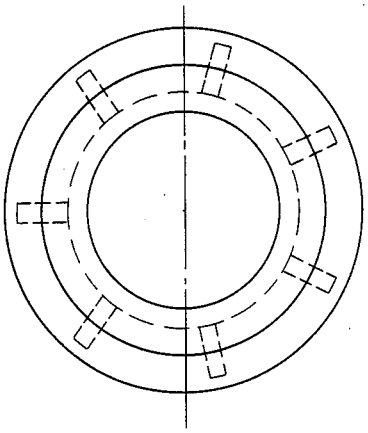
Figure 1:
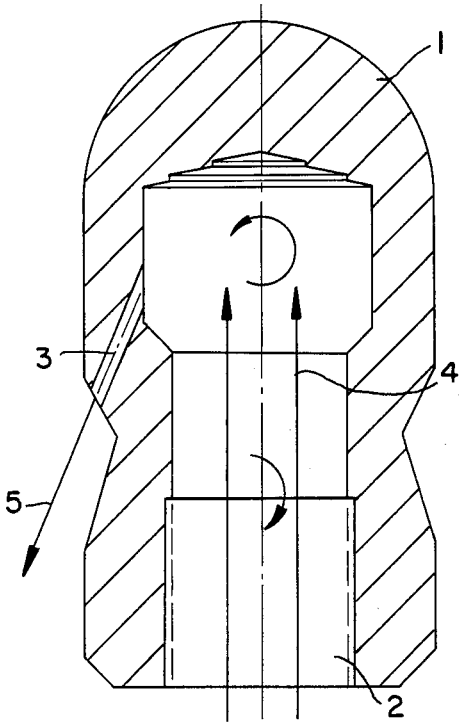
FIG. 1 PRIOR ART

FIGS. 1 and 1A show, diagrammatically, a longitudinal section in an axial direction of a known nozzle 1 for hydrodynamic cleaning. When nozzle 1 is used, it is connected to a pressurized water pipe (not shown), in which the pressure is generated by a pumping car engine or the like and which said car is able to advance, as the movable nozzle, which is attached to the pressure pipe, increasingly forces its way along the water pipe. The pressurized water flows into the coaxially disposed opening 2 of nozzle 1 and is forced to pass through channels 3 in nozzle 1. Nozzle 1 is normally provided with from 6 to 8 such channels 3 and nozzles (not shown) are usually provided in the discharge openings of channels 3. Though the nozzle works, its design leads to waste of pumping power, when it is used for cleaning of this kind. Pressurized water flow 4 in feeding opening 2 partly shuts off partial flows 5, which are forced to pass channels 3. A heavy turbulence with frothing results in feeding opening 2 and thus, the pressurized water flow through nozzle 1 is greatly obstructed and the efficiency of the pipe cleaning is poor.

Figure 2A:
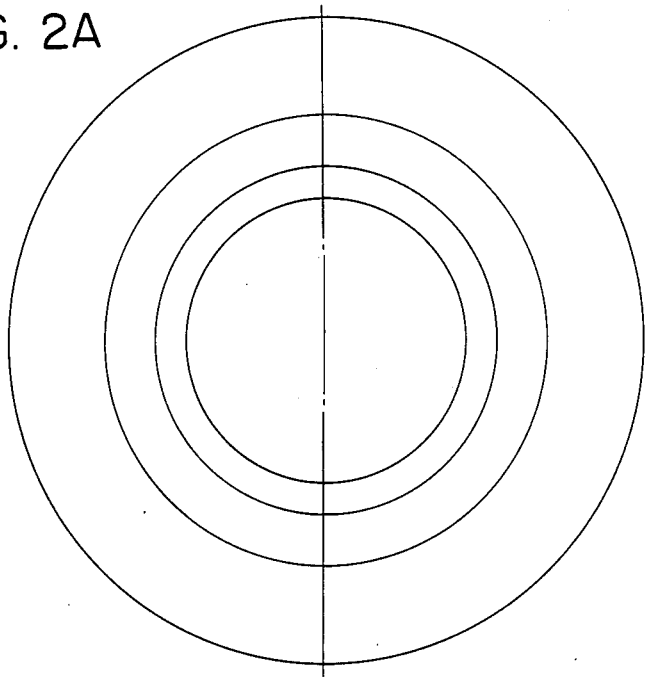
Figure 2:
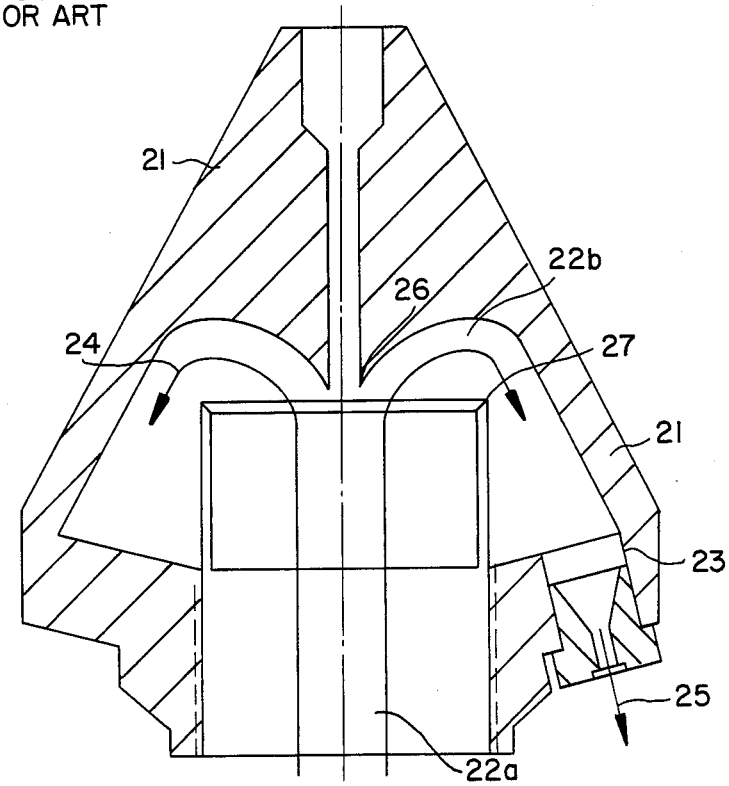
FIG. 2 PRIOR ART

FIGS. 2 and 2A show diagrammatically, a more recent known embodiment of a movable hydrodynamic nozzle 21, by means of which the severest turbulence problems and frothing problems caused have been overcome. Pressurized water 24 from a pumping car engine (not shown) flows through the feeding portion **22*a* in the nozzle and reaches a chamber 22*b* in the nozzle. A flow separation device or guide 26 and the upper portion of feeding tube 27 cause the pressurized water to circulate in chamber 22*b* and to comparatively easily enter the feeding openings of channels 23 in chamber 22*b* and come out of channels 23**. The pressurized flow through the movable hydrodynamic nozzle, designed in this maner, is substantially doubled, provided the rest of the parameters are constant, and the cleaning efficiency is improved correspndingly.

Applicant has now found, quite surprisingly and in accordance with the present invention, that the movable nozzle in FIG. 2, designed to hydrodynamically clean pipe systems, can be further developed and shaped resulting in the almost complete disappearance of turbulence and frothing in the nozzle caused by the same. The important distinguishing feature of the present invention is that the feed opening of each channel in the nozzle is situated in that inner wall of the feeding opening in the nozzle, which is perpendicularly disposed in relation to the direction of the pressurized water flow. Thus, when pressurized water is forcing its way into each of said channels, the water has the same direction as the water in the feeding opening, but the channels are curved to the extent that, when the pressurized water comes out of the channels, it flows obliquely backwards in relation to the nozzle as is known in the art. In this way hardly any turbulence and frothing in the nozzle appears and the feeding of the pressurized water into the channels is obstructed surprisingly little. Thus, the overall pressurized water flow through the nozzle is facilitated and the ratio between the pumping force and the cleaning efficiency is very satisfactory.

In a first preferred embodiment of the present invention means are provided in the feeding opening of the nozzle, which additionally facilitates the admission of the pressurized water in the channels, e.g. cup shaped surfaces around the feeding openings of the channels and/or an coaxially disposed flow separator or guide, preferably shaped as a cone with its top in the upstream direction.

In another preferred embodiment of the present invention the distance between the inlet opening and the outlet opening of each channel is as large as it is possible to make it, considering the outer chape of the nozzle and the direction and the position of the outlet opening in order to maximize the curve radius of the channel and lower the resistance to the pressurized water flow through the nozzle.

In a third embodiment of the present invention the outlet opening of each channel is provided with a set of exchangeable nozzles having outlet openings of different diameters.

The present invention will be described more in detail in the following text, reference being made to the enclosed drawings:

FIGS. 1 and 2 each illustrate a bottom and cross sectional elevational view of a prior art embodiment of a hydrodynamic nozzle.

FIGS. **3*a* and 3*b* are diagrammatical bottom views of a movable hydrodynamic nozzle according to the present invention. The nozzle is viewed in the direction of the pressurized water flow; and FIG. 4** is a diagrammatic longitudinal section in an axial direction.

FIG. **3*a* shows an embodiment of the movable hydrodynamic nozzle according to the present invention. Nozzle 31 is shown in an axial direction and in the downstream direction. Pressurized water, which enters the inlet opening 32 of the nozzle, hits the cup and quadrant shaped surfaces A, C, B and D at the inner end of inlet opening 32 and is guided by these surfaces into inlet openings $A_1$, $C_1$, $B_1$ and $D_1$ respectively of the four channels 33 in nozzle 31. The pressurized water proceeds in said four channels and is discharged from outlet openings $A_2$, $C_2$, $B_2$ and $D_2$ respectively of channels 33. Outlet opening $A_2$ and inlet $A_1$ are diametrically opposed, outlet opening $C_2$ and inlet opening $C_1$ are diametrically opposed etc. and thus, the curve radius of channels 33 from $A_1$ to $A_2$, from $C_1$ to $C_2$ etc in nozzle 31** is maximized and the overall resistance to the pressurized water flow in the nozzle is low. Also, that is why, the pumping pressure in the pressurized water feed pipe is constant and, the cleaning efficiency is high. This increase is surprisingly large. The efficiency is twice as high as the efficiency of the known nozzle according to FIG. 2 and roughly four times as high as the efficiency of the known nozzle according to FIG. 1.

Figure 3A:
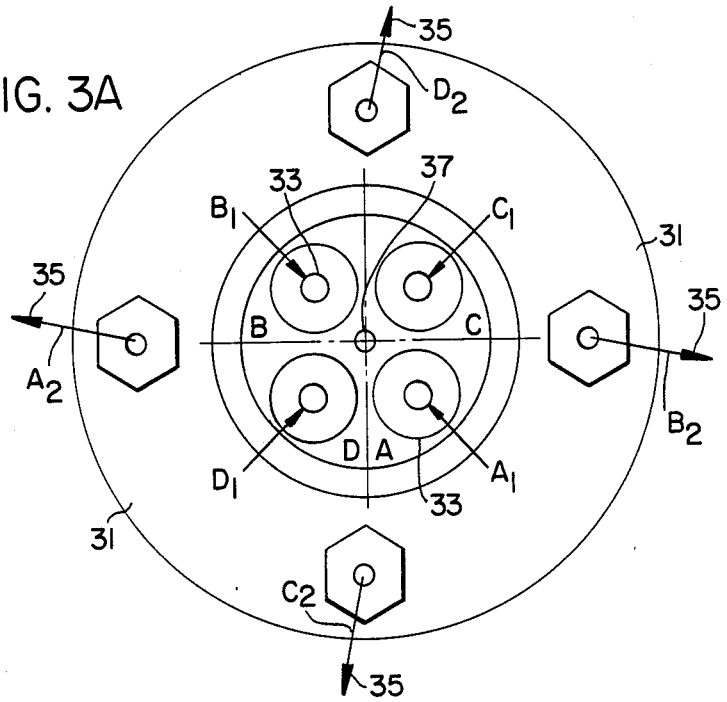
Figure 3B:
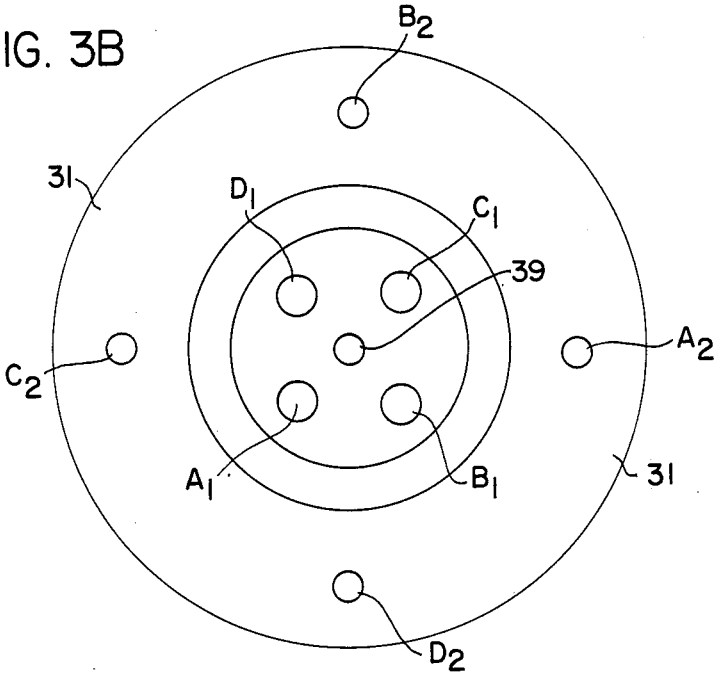

FIG. 3*b* shows a preferred embodiment of the present invention, which is similar to the embodiment shown in FIG. 3*a*, but it is provided with an axially disposed pressurized water flow divider 39, which is mainly conically shaped and the top of which is disposed in an upstream direction. The flow divider 39 is, according to a particular embodiment of the present invention, combined with cup shaped pressurized water flow directing surfaces A, C, B and D around inlet openings $A_1$, $C_1$, $B_1$ and $D_1$ respectively of channels 33.

Figure 4:
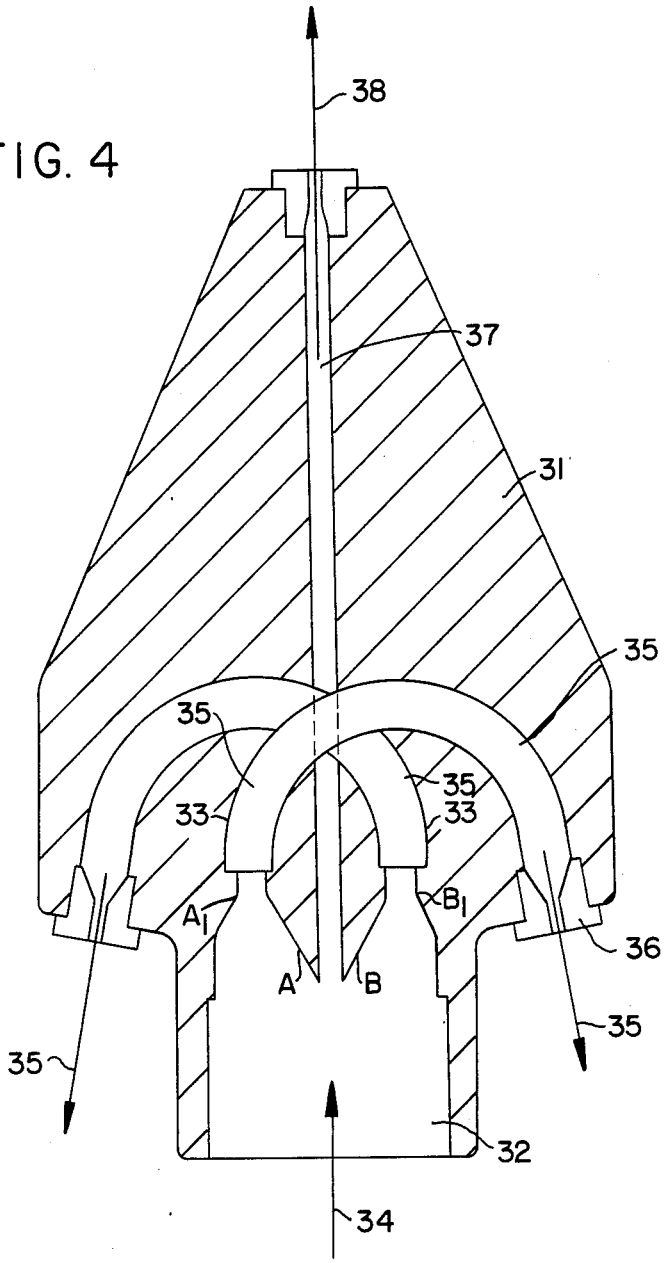

FIG. 4 is a longitudinal section of the nozzle according to FIG. 3*a*, an axial plane through two diametrically opposed channels 33. Pressurized water 34 flows into inlet opening 32 of nozzle 31 towards cup shaped surfaces A and B, where it divides into inlet openings $A_1$ and $B_1$ respectively of channels 33 and out of outlet openings $A_2$ and $B_2$ respectively of said channels. Channels 33 are made of suitable metal pipe and nozzle 31 of a plastic material, which surrounds the channels. One of several channels 37 having a downstream direction and a comparatively small inner diameter is also shown in the figure. The cleaning work may be facilitated, if pressurized water jets 38 having a downstream direction start the dissolving of deposits of sand, soil, sludge etc, in the water pipe, which may be completely clogged. One small nozzle 36 is shown in outlet opening $A_2$.

I claim:

1. A movable hydrodynamic nozzle for pressurized water cleaning of pipe systems, said nozzle having an exterior surface, a pressurized water main inlet opening and at least two tubular channels each having an inlet opening in said main inlet opening and an outlet opening in the exterior surface of said nozzle, said channels transmitting the pressurized water out of said nozzle obliquely backwards in relation to the direction of the pressurized water flowing through said main inlet opening, each of said channels being essentially semicircular in shape and each of said channels having their inlet opening positioned so that the pressurized water flows into said channels in essentially the same direction as the flow direction in said main inlet opening, each of siad inlet openings being positioned, with respect to its correspondence outlet opening, on one side of a plane which longitudinally bisects said nozzle and is perpendicular to a line extending from a midpoint of the corresponding outlet opening to an axially extending center line of said nozzle, while the corresponding outlet opening is itself positioned on the opposite side of said plane, such that the inlet openings and corresponding outlet openings have diametrically opposed positions and the curve radii of said channels are optimally large in view of the position of the outlet openings on the exterior surface of said nozzle, by means of which the total resistance of the nozzle to the pressurized water flow is low and the cleaning efficiency is high.

2. The nozzle according to claim 1, wherein said nozzle has formed therein a bore having a central axis coincident with the axial extending center line, and the bore extending from said main inlet opening to the exterior surface of said nozzle.

3. The nozzle according to claim 2 wherein the bore is conical in shape with its base portion opening into the main inlet opening.

4. The nozzle according to claim 2, wherein said main inlet opening has an inner wall which is provided with cup shaped surfaces around said inlet openings of said channels to facilitate the entering of the pressurized water in said channels and lessen the overall resistance of said nozzle to the pressurized water flow.

5. The nozzle according to claim 4 wherein the bore is conical in shape with its base portion opening into the main inlet opening.

6. The nozzle according to claim 1 wherein said main inlet opening has an inner wall which is provided with cup shaped surfaces around said inlet openings of said channels to facilitate the entering of the pressurized water in said channels and lessen the overall resistance of said nozzle to the pressurized water flow.

* * * * *